US008958709B2

(12) United States Patent
Suzuki et al.

(10) Patent No.: US 8,958,709 B2
(45) Date of Patent: Feb. 17, 2015

(54) IMAGE FORMING APPARATUS HAVING A SECOND RESISTOR PORTION WITH A HIGHER ELECTRICAL RESISTANCE THAN A FIRST RESISTOR PORTION

(71) Applicant: Canon Kabushiki Kaisha, Tokyo (JP)

(72) Inventors: Masahiro Suzuki, Numazu (JP); Masaru Shimura, Yokohama (JP); Shinji Katagiri, Yokohama (JP); Tatsuya Kinukawa, Kawasaki (JP); Shigeru Hoashi, Numazu (JP); Akinori Takayama, Yokohama (JP); Takeo Kawanami, Yokohama (JP); Michio Uchida, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 65 days.

(21) Appl. No.: 13/676,960

(22) Filed: Nov. 14, 2012

(65) Prior Publication Data

US 2013/0136509 A1 May 30, 2013

(30) Foreign Application Priority Data

| | | |
|---|---|---|
| Nov. 24, 2011 | (JP) | 2011-256705 |
| Nov. 24, 2011 | (JP) | 2011-256706 |
| Nov. 24, 2011 | (JP) | 2011-256707 |
| Dec. 27, 2011 | (JP) | 2011-286210 |

(51) Int. Cl.
*G03G 15/16* (2006.01)
*G03G 15/01* (2006.01)

(52) U.S. Cl.
CPC ..... *G03G 15/1605* (2013.01); *G03G 15/0131* (2013.01); *G03G 15/1615* (2013.01); *G03G 15/168* (2013.01)
USPC ..... 399/66; 399/302; 399/313

(58) Field of Classification Search
USPC ..... 399/66, 121, 302, 315
See application file for complete search history.

(56) References Cited

U.S. PATENT DOCUMENTS

| | | | | |
|---|---|---|---|---|
| 5,189,472 | A * | 2/1993 | Haneda et al. | 399/164 |
| 6,075,965 | A * | 6/2000 | Tombs et al. | 399/308 |

(Continued)

FOREIGN PATENT DOCUMENTS

| | | | |
|---|---|---|---|
| JP | 05281859 | A * | 10/1993 |
| JP | 2001-324884 | A | 11/2001 |
| JP | 2002-174966 | A | 6/2002 |
| JP | 2004-29057 | A | 1/2004 |
| JP | 2005-242198 | A | 9/2005 |
| JP | 2005-266247 | A | 9/2005 |
| JP | 2009-69466 | A | 4/2009 |

OTHER PUBLICATIONS

English Machine Translation of Handa, Osamu. Image Forming Device, Nov. 22, 2001. Japanese Patent Office JP2001-32884.*

(Continued)

*Primary Examiner* — Clayton E Laballe
*Assistant Examiner* — Trevor J Bervik
(74) *Attorney, Agent, or Firm* — Canon USA Inc IP Division

(57) ABSTRACT

In an image forming apparatus, one of a plurality of support members supporting an intermediate transfer belt is a guide member configured to regulate the rotational direction of the intermediate transfer belt while being held in sliding contact with the intermediate transfer belt at a position opposite the secondary transfer member across the intermediate transfer belt. This guide member is equipped with a first resistor portion in sliding contact with the intermediate transfer belt and a second resistor portion of a higher electrical resistance than the first resistor portion, with the second resistor portion provided upstream of the first resistor portion in the rotational direction of the intermediate transfer belt.

18 Claims, 14 Drawing Sheets

(56) References Cited

U.S. PATENT DOCUMENTS

| | | | | |
|---|---|---|---|---|
| 7,346,287 | B2 * | 3/2008 | Ogiyama et al. | 399/66 |
| 7,856,200 | B2 * | 12/2010 | Wada et al. | 399/303 |
| 7,965,959 | B2 * | 6/2011 | Ishikawa | 399/121 |
| 2010/0135703 | A1 * | 6/2010 | Nakamura et al. | 399/313 |
| 2011/0182630 | A1 * | 7/2011 | Shirafuji et al. | 399/308 |

OTHER PUBLICATIONS

English Machine Translation of Deki, Takeshi. Image Forming Device with Transfer Belt, Oct. 29, 1993. Japanese Patent Office JP05-281859.*

* cited by examiner

IMAGE FORMING APPARATUS HAVING A SECOND RESISTOR PORTION WITH A HIGHER ELECTRICAL RESISTANCE THAN A FIRST RESISTOR PORTION

BACKGROUND OF THE INVENTION

1. Field of the Invention

The present disclosure relates to an image forming apparatus such as a copying machine and a laser printer.

2. Description of the Related Art

In a known electrophotographic color image forming apparatus, image forming units for forming yellow, magenta, cyan, and black images are independently provided for high speed printing, and the images are successively transferred from the image forming units to an intermediate transfer member, and are further transferred collectively from the intermediate member to a transfer material.

Japanese Patent Application Laid-Open No. 2004-29057 discusses an image forming apparatus using an endless intermediate transfer belt as the intermediate transfer member. A secondary transfer roller is used as a secondary transfer member, and one of support rollers supporting the inner peripheral surface of the intermediate transfer belt is used as a roller opposing the secondary transfer roller. The secondary transfer roller press-contacts the opposing roller across the intermediate transfer belt, forming a secondary transfer region where the secondary transfer roller and the intermediate transfer belt are held in contact with each other.

The transfer material is conveyed to the secondary transfer region where a difference in potential is generated between the secondary transfer roller to which a voltage is applied and the opposing roller which is grounded, and a toner image on the intermediate transfer belt is electrostatically transferred to the transfer material.

However, the image forming apparatus which forms the secondary transfer region with the intermediate transfer belt, the secondary transfer roller, and the opposing roller has the following problem.

The action of an electric field generated between the two rollers of the secondary transfer roller and the opposing roller is exerted not only on the secondary transfer region but also on the periphery thereof. The action of the electric field is also exerted at an inlet region situated on the upstream side of the secondary transfer region, so that, in some cases, before the transfer material enters the secondary transfer region, the toner image on the intermediate transfer belt is electrostatically moved onto the transfer material at the inlet region. As a result, the toner image is transferred to a position on the transfer material different from the predetermined position (the proper position to which the image ought to be transferred), so that the image is disturbed and splattered, resulting in deterioration in image quality. In the following, this phenomenon will be referred to as splattering.

To suppress the splattering phenomenon, according to Japanese Patent Application Laid-Open No. 2009-69466, in the vicinity of the secondary transfer region, a support roller is arranged on the upstream side of the opposing roller on the inner peripheral side of the intermediate transfer belt. To save space, this support roller is formed as a small diameter roller, and has a function to regulate the position of the intermediate transfer belt such that the recording material enters the secondary transfer region along the intermediate transfer belt. As a result, the splattering phenomenon is suppressed on the upstream side of the secondary transfer region.

However, in this construction, it is necessary to arrange a support roller on the upstream side of the secondary transfer region, resulting in a rather complicated construction.

SUMMARY OF THE INVENTION

The present disclosure is directed to an image forming apparatus which suppresses splattering with a relatively simple construction and which is capable of forming a high quality image.

According to an aspect of the present disclosure, an image forming apparatus includes an image bearing member bearing a toner image, an endless intermediate transfer belt which is rotatable and to which the toner image is primarily transferred from the image bearing member, a plurality of support members supporting an inner peripheral surface of the intermediate transfer belt, and a secondary transfer member contacting an outer surface of the endless intermediate transfer belt and configured to form a secondary transfer region together with the endless intermediate transfer belt, the toner image on the endless intermediate transfer belt being secondarily transferred to a transfer material conveyed to the secondary transfer region. One of the plurality of support members is a guide member configured to regulate the rotational direction of the endless intermediate transfer belt while slide-contacting the endless intermediate transfer belt at a position opposite the secondary transfer member across the endless intermediate transfer belt, and the guide member includes a first resistor portion in sliding contact with the endless intermediate transfer belt and a second resistor portion of a higher electrical resistance than the first resistor portion, with the second resistor portion provided upstream of the first resistor portion in the rotational direction of the endless intermediate transfer belt.

According to another aspect disclosed herein, an image forming apparatus includes an image bearing member bearing a toner image, an endless intermediate transfer belt which is rotatable and to which the toner image is primarily transferred from the image bearing member, a plurality of support members supporting an inner peripheral surface of the endless intermediate transfer belt, and a secondary transfer member contacting an outer surface of the endless intermediate transfer belt and configured to form a secondary transfer region together with the endless intermediate transfer belt, the toner image on the endless intermediate transfer belt being secondarily transferred to a transfer material conveyed to the secondary transfer region. One of the plurality of support members is a guide member configured to regulate the rotational direction of the endless intermediate transfer belt while being held in sliding contact with the endless intermediate transfer belt at a position opposite the secondary transfer member across the endless intermediate transfer belt, and the guide member includes a plurality of sliding contact portions differing in radius of curvature in the rotational direction of the endless intermediate transfer belt.

Further features and aspects of the present disclosure will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles disclosed herein.

DESCRIPTION OF THE EMBODIMENTS

Various exemplary embodiments, features, and aspects of the disclosure will be described in detail below with reference to the drawings.

The components of these exemplary embodiments are only presented by way of example, and do not restrict a scope of the invention.

Figure 1:
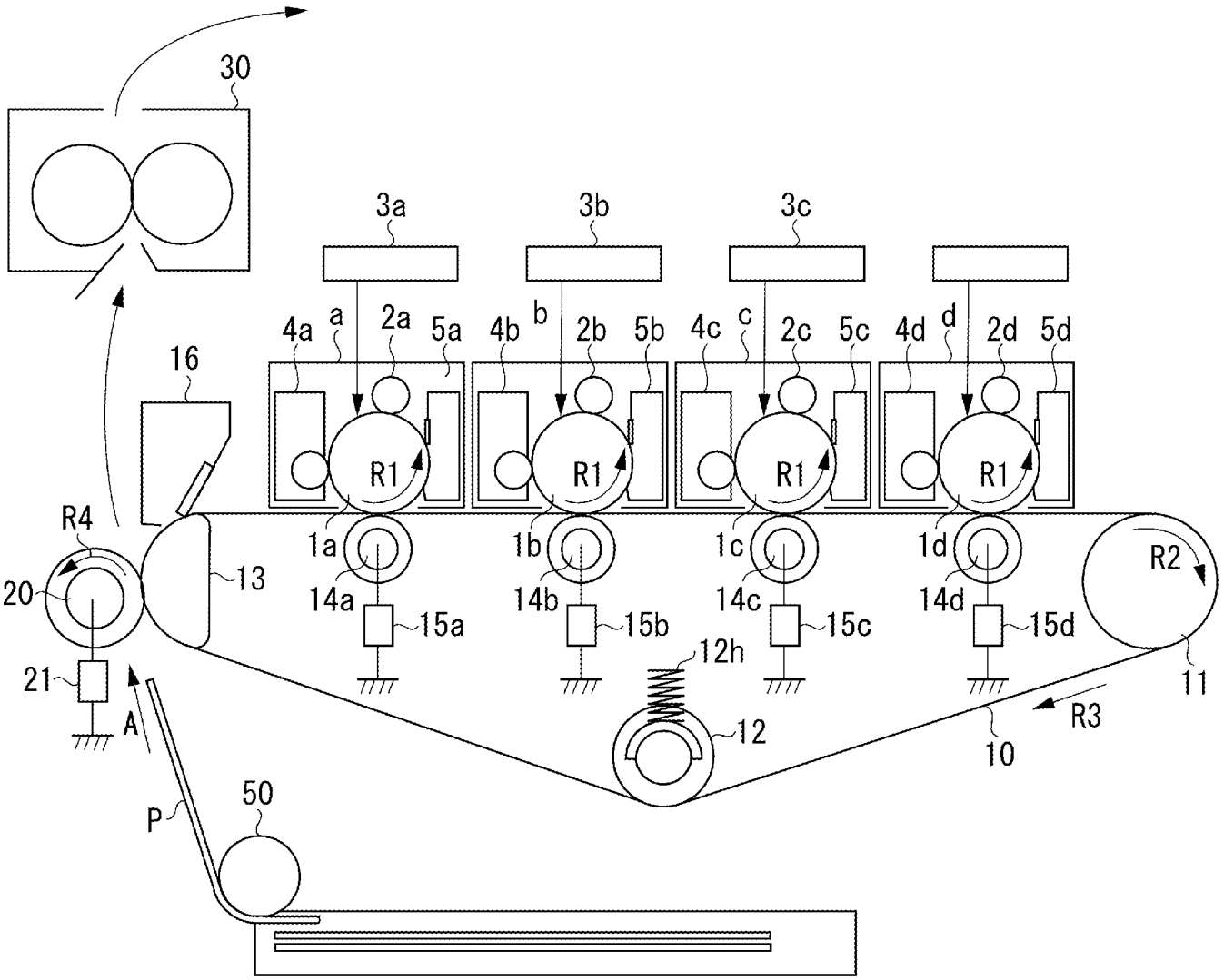
FIG. 1 is a schematic sectional view of an image forming apparatus according to an exemplary embodiment.

FIG. 1 is a schematic diagram illustrating an in-line type (four-drum type) color image forming apparatus. The image forming apparatus is equipped with four image forming units: an image forming unit a for forming a yellow image; an image forming unit b for forming a magenta image; an image forming unit c for forming a cyan image; and an image forming unit d for forming a black image. These four image forming units are arranged in a row at a fixed interval.

The image forming units are of the same construction except for the color of the image formed, so the image forming unit a will be described as the representative.

The image forming unit a is equipped with a drum-like electrophotographic photosensitive member (hereinafter referred to as the photosensitive drum) 1*a*, a charging member 2*a*, a developing unit 4*a*, and a cleaning unit 5*a*. In the image forming unit a of the present exemplary embodiment, these members and units are integrated into a process cartridge attachable and detachable to and from the apparatus main body.

The photosensitive drum 1*a* is rotated at a predetermined peripheral speed (process speed) in the direction of the arrow R1. In this rotation process, the photosensitive drum 1*a* is uniformly charged to a predetermined polarity/potential by a charging roller 2*a* constituting the charging member. In the present exemplary embodiment, the photosensitive drum 1*a* is charged to a negative polarity by the charging roller 2*a*. Next, image exposure is carried out by an exposure unit 3*a*. As a result, an electrostatic latent image corresponding to the desired yellow component image is formed.

Next, the electrostatic latent image is visualized by a first developing unit (yellow developing device) 4*a* at a development position as a yellow toner image. The yellow developing device 4*a* stores yellow toner charged to the negative polarity and development is performed on the photosensitive drum 1*a* by a development roller provided in the yellow developing device. The photosensitive drum 1*a* is a toner image bearing member.

The yellow toner image is primarily transferred to an opposing intermediate transfer member. An intermediate transfer belt 10 constituting the intermediate transfer member is an endless belt, which is supported by a plurality of support members, and which is rotated at substantially the same peripheral speed as the photosensitive drum 1 in the direction of the arrow R3, i.e., in the same direction as the photosensitive drum 1 while being in contact therewith at an opposing portion. A primary transfer member is provided at a position opposite the photosensitive drum 1*a* across the intermediate transfer belt 10. The yellow toner image formed on the photosensitive drum 1*a* is primarily transferred onto the intermediate transfer belt 10 as it passes a primary transfer portion where the photosensitive drum 1*a* and the intermediate transfer belt 10 are held in contact with each other. In this process, a primary transfer voltage is applied from a primary transfer power source 15*a* to a primary transfer roller 14*a*, which is a primary transfer member constituting the primary transfer unit.

The first transfer residual toner remaining on the surface of the photosensitive drum 1*a* is removed through cleaning by the cleaning unit 5*a*.

In a similar fashion, a magenta toner image, a cyan toner image, and a black toner image are formed in the image forming units (b) through (d), and these toner images are successively transferred onto the intermediate transfer belt 10 so as to be superimposed, thereby obtaining a composite color image corresponding to the target color image. The image forming units (b) through (d) are respectively provided with corresponding exposure units 3*b* through 3*d* and primary transfer rollers 14*b* through 14*d*.

The toner images in four colors on the intermediate transfer belt 10 are secondarily transferred onto the surface of a transfer material P conveyed from a feeding unit 50 as it passes a secondary transfer region formed by the intermediate transfer belt 10 and a secondary transfer roller 20 constituting a secondary transfer region member. In the process, a secondary transfer voltage is applied to the secondary transfer roller 20 from a secondary transfer power source 21. The secondary transfer roller 20 constituting the secondary transfer member consists of a roller of an outer diameter of 18 mm formed by covering a nickel-plated steel bar of an outer diameter of 8 mm with a foam sponge of nitrile-butadiene rubber (NBR) adjusted to a resistance value of $10^8$ Ω·cm and a thickness of 5 mm. Further, the secondary transfer roller 20 is held in contact with the outer peripheral surface of the intermediate transfer belt 10 with a pressing force of 50 N, and is configured to be driven to rotate with respect to the intermediate transfer belt 10.

After this, the transfer material P bearing the four-color toner image is introduced into the fixing device 30, where it is heated and pressed, whereby the toners in the four colors are molten and mixed while fixed to the transfer material P. Then, the transfer material P is discharge to the exterior of the apparatus.

By the above operation, a full-color print image is formed on the transfer material P. The secondary transfer residual toner remaining on the surface of the transfer belt 10 is removed through cleaning by the intermediate transfer belt cleaning unit 16.

Next, the intermediate transfer belt 10 and a plurality of support members 11, 12, and 13 supporting the inner peripheral surface of the intermediate transfer belt 10 will be described. The intermediate transfer belt 10 and the support members 11, 12, and 13 are integrated into an intermediate transfer unit, which is attachable and detachable to and from the apparatus main body. It is desirable that the intermediate transfer belt 10 shows little residual charge after transfer so that no charge elimination mechanism can be required. In the present exemplary embodiment, it is desirable that the intermediate transfer belt is formed of a material whose volume resistivity is approximately $10^8$ to $10^{11}$ Ω·cm so that little residual charge after transfer may be involved to make the provision of a charge elimination mechanism unnecessary. The intermediate transfer belt 10 according to the present exemplary embodiment is formed of a material whose main component is poly vinylidene fluoride (PVdF) of a volume resistivity of $10^9$ Ω·cm in a thickness of 100 μm. Furthermore, the materials of the intermediate transfer belt 10 that may be used include polyamide (PI) and polyether ether ketone (PEEK), for example.

The support member 11 is a drive roller, which is a drive member configured to support the intermediate transfer belt 10 while driving it. It is configured to rotate in the direction of the arrow R2, causing the intermediate transfer belt 10 to rotate in the direction of the arrow R3. The present exemplary embodiment employs, as the support member 11, a roller consisting of an aluminum shaft of an outer diameter of 20 mm covered with elastic rubber (ethylene propylene rubber) with a thickness of 0.5 mm.

The support member 12 is a tension roller imparting tension to the inner peripheral surface of the intermediate transfer belt 10 from the inner peripheral side toward the outer peripheral side. The present exemplary embodiment employs, as the support roller 12, a hollow aluminum shaft of an outer diameter of 20 mm. The support member 12 presses the intermediate transfer belt 10 with a total pressure of 39.2 mm by a spring 12*h*, imparting tension to the intermediate transfer belt 10.

The support member 13 is a guide member opposite the secondary transfer roller 20 across the intermediate transfer belt 10. At the position where it faces the secondary transfer roller 20 across the intermediate transfer belt 10, the guide member 13 regulates the rotational direction of the intermediate transfer belt 10 while being in sliding contact with the intermediate transfer belt 10. Instead of rotating together with the intermediate transfer belt 10 like the other support members, the guide member 13 is fixed to the intermediate transfer unit. The construction of the guide member 13 will be described below.

The intermediate transfer belt 10, the support members 11, 12, and 13, and primary transfer rollers 14*a* through 14*d* are integrated into the intermediate transfer unit. The drive roller 11, the tension roller 12, and the primary transfer rollers 14*a* through 14*d*, which are rollers, can rotate being respectively supported by bearings. On the other hand, the guide member 13 is fixed to a frame body constituting the intermediate transfer unit.

In the following, the construction of the guide member 13 will be described. The guide member 13 according to the present exemplary embodiment is a guide member held in sliding contact with the intermediate transfer belt 10. On the surface of the guide member 13 held in sliding contact with the intermediate transfer belt 10, the guide member 13 has portions showing different electrical resistance, in the moving direction of the intermediate transfer belt 10.

Figure 2:
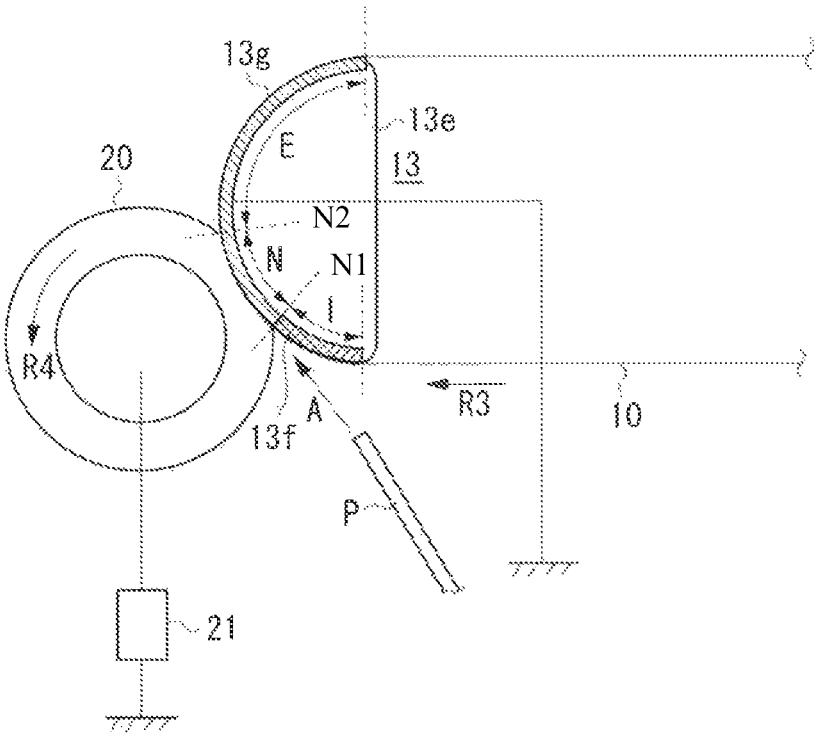
FIG. 2 is an enlarged schematic sectional view of a portion in the vicinity of a secondary transfer region of an image forming apparatus according to a first exemplary embodiment.

FIG. 2 is an enlarged schematic cross-sectional view of the portion in the vicinity of the secondary transfer region of the image forming apparatus according to the present exemplary embodiment. The surface of the guide member 13 held in sliding contact with the intermediate transfer belt 10 is divided into three regions in the rotational direction of the intermediate transfer belt 10: a secondary transfer region N, an inlet region I on the upstream side thereof, and an outlet region E on the downstream side thereof.

The guide member 13 is equipped with a guide support member 13*e*, a low resistance sliding contact portion 13*g* constituting a first resistor portion, and a high resistance sliding contact portion 13*f* constituting a second resistor portion. The high resistance sliding contact portion 13*f* and the low resistance sliding contact portion 13*g* are provided on the sliding contact surface where the intermediate transfer belt 10 and the guide member 13 are held in sliding contact with each other. Further, the high resistance sliding contact portion 13*f* and the low resistance sliding contact portion 13*g* are supported by a guide support member 13*e*. The high resistance sliding contact portion 13*f* exhibits a higher electrical resistance than the low resistance sliding contact portion 13*g*. In the present exemplary embodiment, the surface of the guide support member 13*e* held in contact with the intermediate transfer belt 10 is formed as a curved surface of a radius of curvature of 12 mm.

It is desirable that this radius of curvature is set within a range of 8 mm to 15 mm. When the radius of curvature is smaller than 8 mm, the curvature is too large, and there is concern of a so-called curling, i.e., a mark indicating that it has been supported by the guide member 13. The curling is generated in the intermediate transfer belt 10 when it is left in a high temperature condition. If a toner image is transferred onto the intermediate transfer belt 10 in which curling occurs, an image defect is generated.

On the other hand, when the radius of curvature is larger than 15 mm, the curvature is too small, which leads to deterioration in the transfer material P separation performance since the transfer material P utilizes curvature separation. If a transfer material of little firmness like a thin sheet is fed, the transfer material may be wrapped around the intermediate transfer belt 10, resulting in a separation defect. Further, the small curvature leads to a larger size of the entire intermediate transfer unit.

It is desirable that the guide support member 13*e* is formed of an insulating material whose volume resistivity is not less than $10^{12}$ Ω·cm. The guide support member 13*e* is not exposed to the sliding contact surface with the intermediate transfer belt 10, so that it may be formed of any insulating material so long as it provides a sufficient level of rigidity. By way of example, the guide support member according to the present exemplary embodiment is formed of an insulating ABS resin. Further, to increase the rigidity of the guide support member 13*e*, it is also possible to add a reinforcing member formed of a metal material or the like.

The high resistance sliding contact portion 13*f* is arranged on the upstream side of the low resistance sliding contact position 13*g* in the rotational direction of the intermediate transfer belt 10. The high resistance sliding contact portion 13*f* is provided at least on the upstream side of the most upstream position (indicated by numeral N1 in FIG. 2) in the rotational direction of the secondary transfer region N where the secondary transfer roller 20 is held in contact with the outer surface of the intermediate transfer belt 10. In FIG. 2, the high resistance sliding contact portion 13*f* is provided at an inlet region I which is a region on the upstream side of the position N1.

It is desirable to adopt, as the material of the high resistance sliding contact portion, an insulating material whose volume resistivity is not less than $10^{12}$ Ω·cm. The present exemplary embodiment employs an insulating super high-molecular polyethylene terephthalate member. A super high-molecular polyethylene is a polyethylene whose molecular mass is heightened to a level of around five million, and is generally known as a material superior in slipping property and wear resistance.

Apart from a super high-molecular polyethylene, it is possible to employ some other material for the high resistance sliding contact portion 13*f* so long as it is a material not hindering the rotation of the intermediate transfer belt 10 and exhibiting satisfactory slipping property. Examples of such a material include fluororesin and polyacetal resin.

On the other hand, the low resistance sliding contact portion 13*g* is arranged between at least the most upstream position N1 in the rotational direction of the secondary transfer region N and the most downstream position N2 in the rotational direction of the secondary transfer region N. In FIG. 2, the surface on the downstream side of the position N1 and held in sliding contact with the intermediate transfer belt 10 entirely consists of the low resistance sliding contact portion 13*g* (In the following, the region E on the downstream side of the position N2 in FIG. 2 will be referred to as the nip outlet region E).

Like the high resistance sliding contact portion 13*f*, the low resistance sliding contact portion 13*g* can also be formed of a material not hindering the rotation of the intermediate transfer belt 10 and exhibiting a satisfactory slipping property. Since it is necessary for the low resistance sliding contact portion 13*g* to function as an opposing electrode in the secondary transfer region N, it is desirable that this sliding contact portion is formed of a material of low electrical resistance. More specifically, it is desirable that the portion is formed of a material whose volume resistivity is not more than $10^{8}$ Ω·cm. The low resistance sliding contact portion 13*g* is electrically grounded by a conductor (not illustrated).

The present exemplary embodiment employs, as the low resistance sliding contact portion 13*g*, a conductive super high-molecular polyethylene sheet of a thickness of 0.2 mm in which carbon is dispersed as the conductive agent. The electrical resistance of this conductive super high-molecular polyethylene sheet is a volume resistivity of not more than $10^{7}$ Ω·cm. As described above, from the viewpoint of satisfactory slipping property, it is desirable to adopt super high-molecular polyethylene sheets as the high resistance sliding contact portion 13*f* and the low resistance sliding contact portion 13*g*.

The drive torque of the intermediate transfer belt 10 is increased by the sliding frictional force of the sliding portion of the guide member and the intermediate transfer belt 10. The sliding frictional force F can be expressed as the product of the coefficient of friction p and the vertical drag applied to the sliding portion and the intermediate transfer belt 10 as follows:

$$F=\mu\times N$$

The vertical drag N is determined by the pressing force of the secondary transfer roller 20, so that it is necessary to reduce the coefficient of friction μ to reduce the sliding frictional force. Further, in order that the sliding portion may not be worn as a result of the sliding on the intermediate transfer belt 10, the sliding portion must exhibit a superior wear resistance performance.

The super high-molecular polyethylene sheet as employed in the present exemplary embodiment has a superior self lubricating property, and exhibits a low coefficient of friction. Its molecular mass is approximately 1 to 7 million, which is larger than the molecular mass of an ordinary polyethylene resin, which ranges from 20,000 to 300,000. Thus, it exhibits a superior wear resistance property.

In the present exemplary embodiment, the surfaces of the high resistance sliding contact portion 13*f* and the low resistance sliding contact portion 13*g* that are the opposing surfaces of the sliding contact surface are attached and fixed to the surface of the guide support member 13*e* by an insulating double-sided tape.

Figure 3:
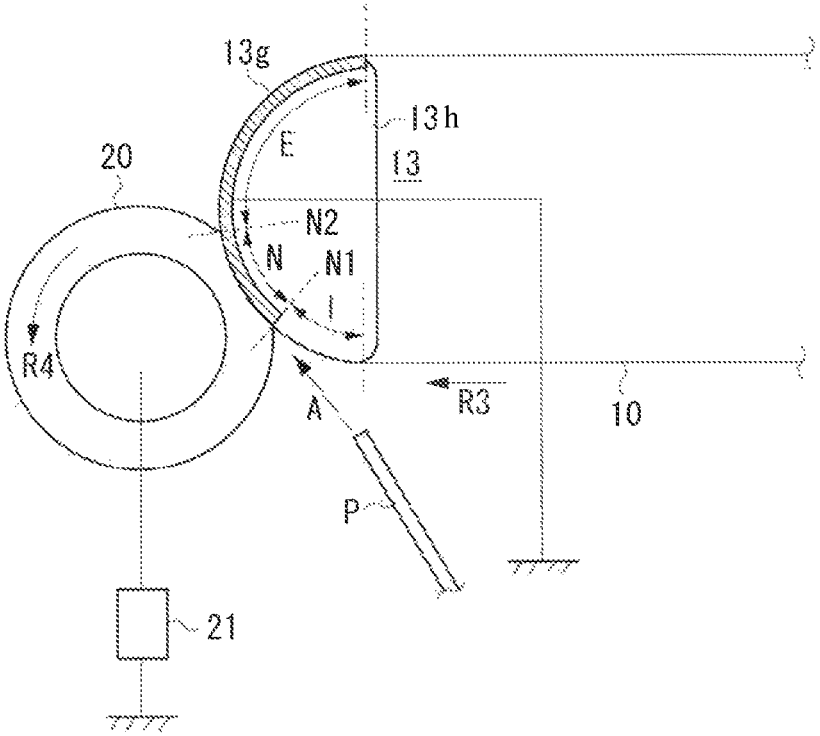
FIG. 3 is an enlarged schematic sectional view of the portion in the vicinity of the secondary transfer region of the image forming apparatus according to the first exemplary embodiment.

FIG. 3 is a schematic diagram illustrating a high resistance support portion 13*h* obtained through integration of the guide support member 13*e* and the high resistance sliding contact portion 13*f* of FIG. 2. At the nip inlet region I of the guide member 13, the high resistance support portion 13*h* is in contact with the intermediate transfer belt 10, and, at the secondary transfer region N and the nip outlet region E, the low resistance sliding contact portion 13*g* is in contact therewith. Further, in order that the sliding contact surfaces of the secondary transfer region N and the outlet region E may be of the same height as the sliding contact surface of the inlet region I, the surface of the high resistance support portion 13*h* where the low resistance sliding contact portion 13*g* is arranged is lowered according to the thickness, so that no step may be generated.

The high resistance support portion 13*h* of FIG. 3 is held in sliding contact with the intermediate transfer belt 10, so that it is desirable that the portion 13*h* is formed of a material exhibiting a satisfactory slipping property with respect to the intermediate transfer belt 10. For example, it may be formed of an insulating polyacetal resin. The high resistance support portion 13*h* illustrated in FIG. 3 can reduce the number of components, and makes it possible to suppress splattering, at low cost and with a simple construction.

Figure 4A:
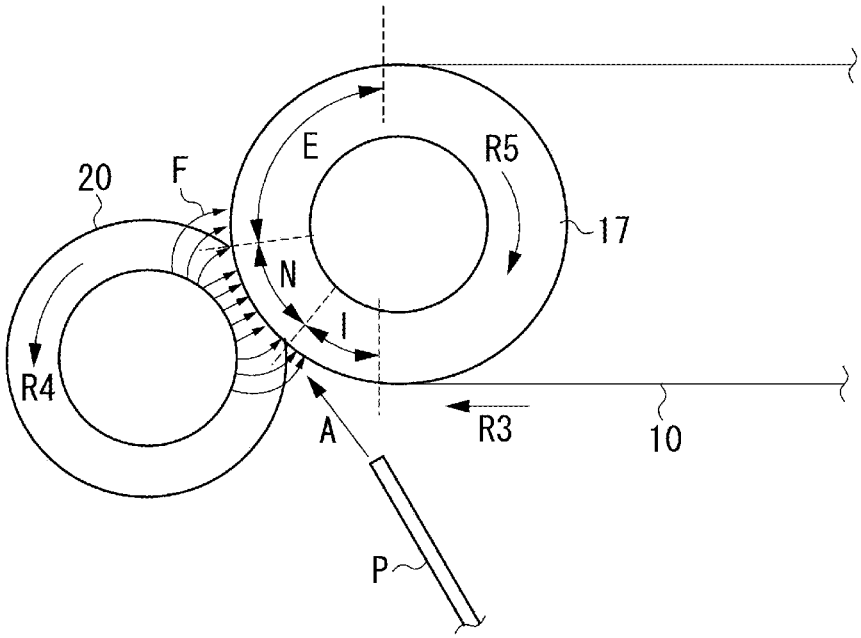
FIG. 4A is a schematic sectional view illustrating an electric field in the vicinity of a secondary transfer region in a case where an opposing roller is employed as an opposing member.
Figure 4B:
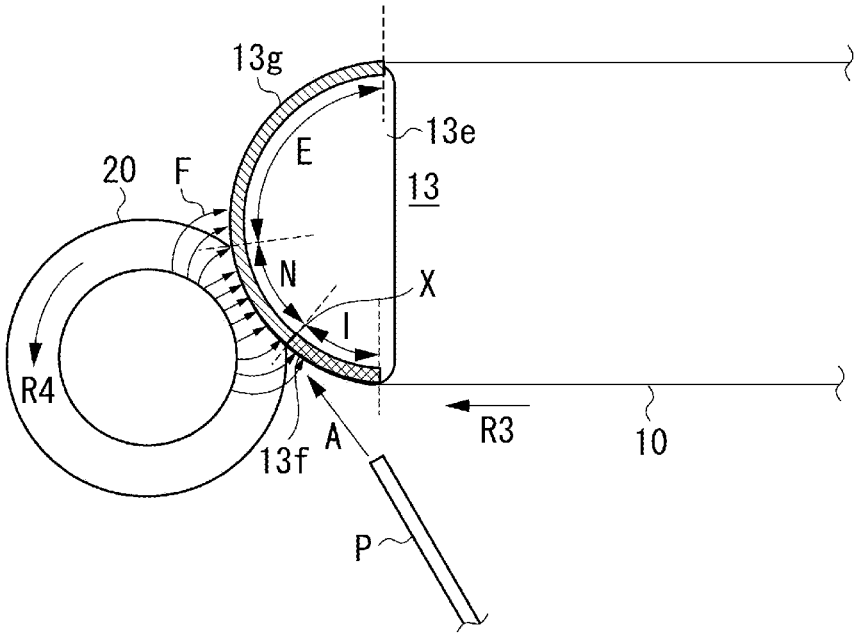
FIG. 4B is a schematic sectional view illustrating the electric field in the vicinity of the secondary transfer region in a case where a guide member according to the first exemplary embodiment is employed.

In the following, the operation of the present exemplary embodiment will be described. FIG. 4A is a schematic diagram illustrating the portion in the vicinity of the secondary transfer region of the image forming apparatus using the conventional transfer counter roller 17, and FIG. 4B is a schematic diagram illustrating the portion in the vicinity of the secondary transfer region of the image forming apparatus employing the guide member 13 according to the present exemplary embodiment. The arrows F in the periphery of the secondary transfer region N schematically indicate the electrical lines of force corresponding to the electric field generated when a secondary transfer voltage of positive polarity is applied to the secondary transfer roller 20.

The construction of FIG. 4A employs, as the transfer counter roller 17, a rubber roller consisting of an aluminum core covered with an elastic rubber in which carbon is dispersed as the conductive agent, and which exhibits a volume resistivity of not more than $10^6$ Ω·cm and an outer diameter of 24 mm.

As illustrated in FIG. 4A, in the space between the secondary transfer roller 20 and the intermediate transfer belt 10 at the inlet region I, there exist the electrical lines of force F directed from the secondary transfer roller 20 toward the transfer counter roller 17 constituting the opposing electrode. Thus, there is the possibility that the toner image on the intermediate transfer belt 10 moves from the intermediate transfer belt 10 toward the secondary transfer roller 20 before entering the secondary transfer region N. Thus, in the construction of FIG. 4A, there is the possibility that a splattering phenomenon occurs before the toner image on the intermediate transfer belt 10 enters the secondary transfer region N.

On the other hand, as illustrated in FIG. 4B, the electrical lines of force from the secondary transfer roller 20 to which a voltage is applied are directed toward the low resistance sliding contact portion 13*g* of the secondary transfer region N constituting the opposing electrode. Thus, due to the absence of the low resistance sliding contact portion 13*g* constituting the opposing electrode at the inlet region I, the electric field is weakened, and the electrical lines of force F are less than in the conventional example illustrated in FIG. 3A. Thus, at the inlet region I, it is hard for the toner image on the intermediate transfer belt 10 to move to the recording material P, thus mitigating the splattering phenomenon.

In the present exemplary embodiment, there exists at the upstream end (indicated by numeral N1 in FIG. 2) of the secondary transfer region N a resistance change point X where the high resistance sliding contact portion 13*f* switches to the low resistance sliding contact portion 13*g* in the moving direction (indicated by the arrow R3) of the intermediate transfer belt 10. The position of the resistance change point X may be slightly deviated to the upstream or downstream side with respect to the upstream end of the secondary transfer region N. However, to suppress generation of splattering, it is desirable that the resistance change point X is situated, if possible, either at the same position as the upstream end of the secondary transfer region N or on the downstream side thereof.

In this way, by providing the guide member in sliding contact with the intermediate transfer belt 10, it is possible to locally change the arrangement of the opposing electrode and the resistance value. As a result, it is possible to regulate the electric field in the vicinity of the secondary transfer region N according to a place within the apparatus.

For the reason mentioned above, it is possible to suppress generation of splattering of the toner image onto the recording material P, making it possible to provide a high quality image.

Next, another exemplary embodiment of the present invention will be described. The basic construction of the image forming apparatus according to the second exemplary embodiment is the same as that of the first exemplary embodiment. Thus, the components that have the same or equivalent functions as those of the first exemplary embodiment will be indicated by the same reference numerals, and a detailed description thereof will be omitted.

As compared with the construction of the first exemplary embodiment, the feature of the present exemplary embodiment lies in that the high resistance sliding contact portion 13*f* is also arranged in the region on the downstream side of the upstream end N1 of the secondary transfer region N (in the secondary transfer region N).

Figure 5:
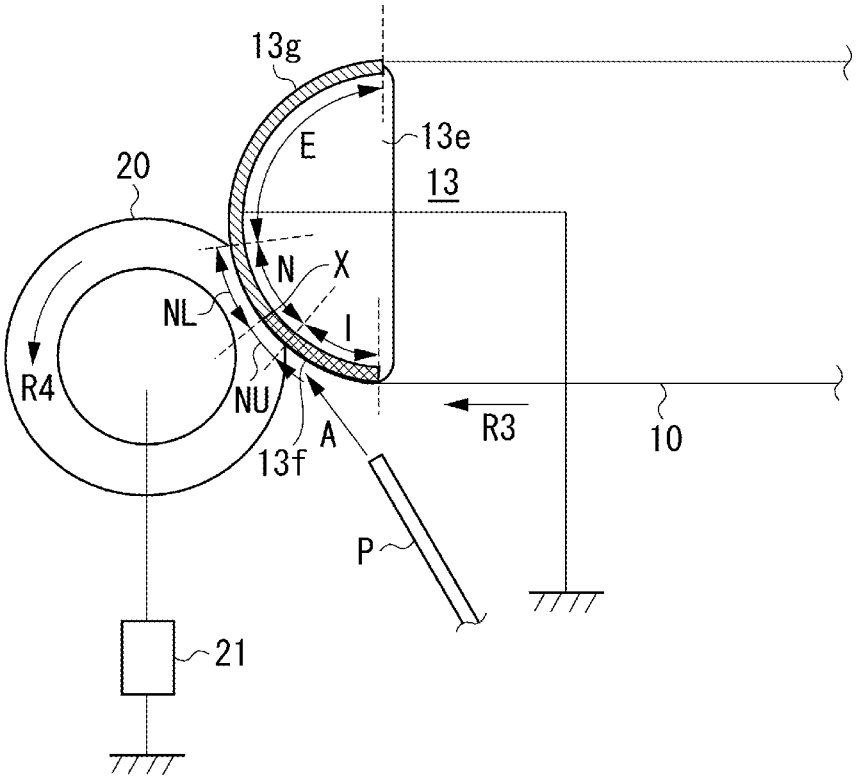
FIG. 5 is an enlarged schematic sectional view of a portion in the vicinity of a secondary transfer region of an image forming apparatus according to a second exemplary embodiment.

FIG. 5 is an enlarged view of the portion in the vicinity of the secondary transfer region for illustrating the guide member 13 according to the present exemplary embodiment. As illustrated in FIG. 5, the high resistance sliding contact portion 13*f* is arranged so as to extend from the inlet region I to the upstream side within the secondary transfer region N. Thus, the secondary transfer region N is divided into an upstream portion NU with no opposing electrode and a downstream portion NL with an opposing electrode. More specifically, there exists within the secondary transfer region N the resistance change point X where the high resistance sliding contact portion 13*f* switches to the low resistance sliding contact portion 13*g* in the moving direction of the intermediate transfer belt 10 (indicated by the arrow R3). The toner image on the intermediate transfer belt 10 is substantially transferred in the downstream portion NL where the low resistance sliding contact member 13*g* constituting the opposing electrode exists.

As described above, in the construction of the present exemplary embodiment, the electric field in the inlet region I is further weakened, and it is possible to bring the toner image on the intermediate transfer belt 10 and the recording material into contact with each other before the toner image is transferred, so that the splattering of the toner onto the recording material P is suppressed still more effectively. Thus, it is possible to provide a high quality image with less splattering than in the first exemplary embodiment.

Next, another exemplary embodiment of the present invention will be described. The basic construction of the image forming apparatus according to the third exemplary embodiment is the same as that of the first exemplary embodiment. Thus, the components having the same or equivalent functions and constructions as those of the first exemplary embodiment will be indicated by the same reference numerals, and a detailed description thereof will be omitted.

As compared with the guide member 13 of the first exemplary embodiment, the feature of the present exemplary embodiment lies in that a guide member 18 is formed so as to exhibit different radiuses of curvature on the upstream side and the downstream side of the secondary transfer region N.

Figure 6:
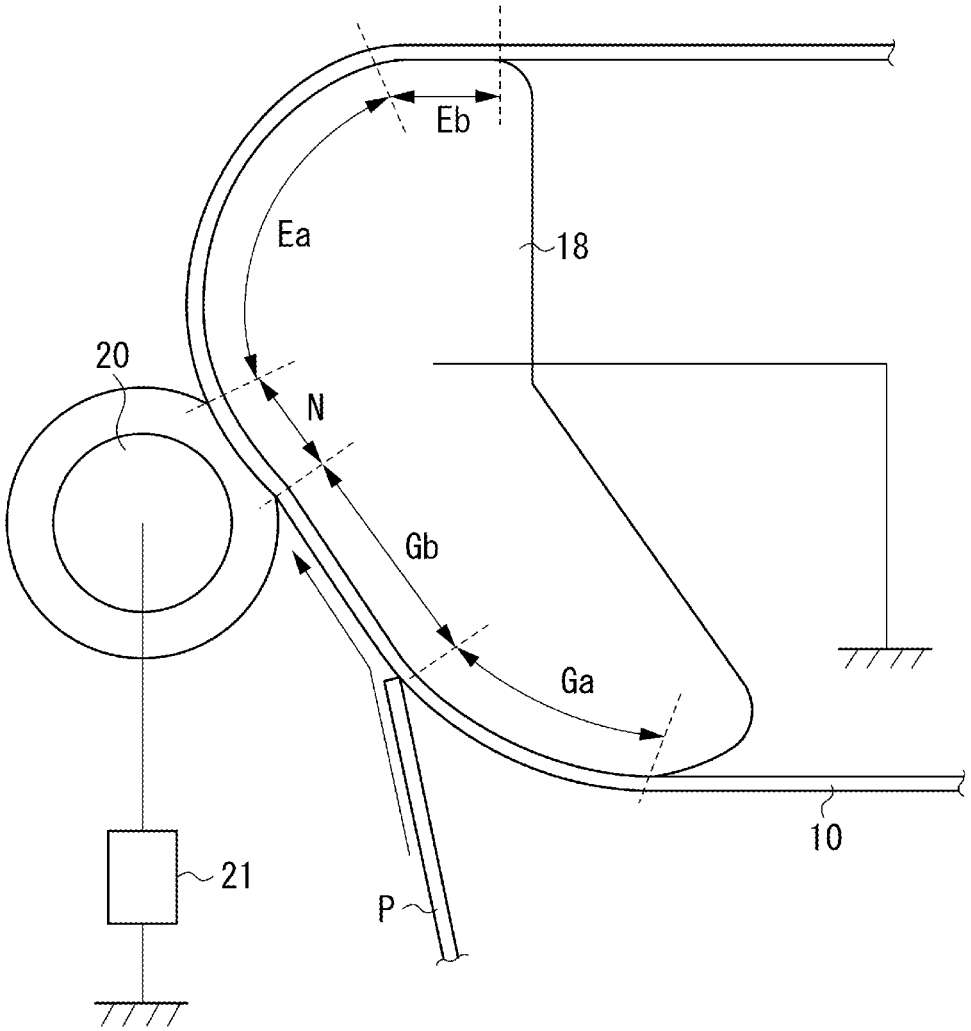
FIG. 6 is an enlarged schematic sectional view of a portion in the vicinity of a secondary transfer region of an image forming apparatus according to a third exemplary embodiment.

The guide member 18 will be illustrated with reference to FIG. 6. FIG. 6 is a schematic sectional view illustrating the portion in the vicinity of the secondary transfer region of the image forming apparatus according to the present exemplary embodiment. The surface of the guide member 18 slide-contacting the intermediate transfer belt 10 is formed by a plurality of continuous sliding contact portions. More specifically, the sliding contact surface is divided into an upstream guide portion Ga, a downstream guide portion Gb, the secondary transfer region N, an upstream outlet portion Ea, and a downstream outlet portion Eb.

The upstream guide portion Ga (first sliding contact portion) functions as a bending portion configured to change the rotational angle of (bend) the intermediate transfer belt 10, and the surface thereof on the side where the guide member 18 is in contact with the intermediate transfer belt 10 is formed as a curved surface of a radius of curvature of 10 mm. From the viewpoint of curling, it is desirable that the intermediate transfer belt according to the present exemplary embodiment has the radius of curvature of not less than 8 mm (not less than a predetermined value). The requisite predetermined value of the radius of curvature for suppressing curling may be changed as appropriate according to the material forming the intermediate transfer belt. While it is desirable that the radius of curvature is large from the viewpoint of curling, an excessively large radius of curvature results in an increase in the size of the apparatus. This will be discussed in detail below.

The downstream guide portion Gb (second sliding contact portion) has the function to cause the recording material P to enter the transfer nip portion N along the guide member 18 to determine the position on the intermediate transfer belt 10 with which the leading edge of the recording material P is brought into contact. The surface on the side where the guide member 18 is held in contact with the intermediate transfer belt 10 is formed as a curved surface of a very large radius of curvature or substantially as a flat surface. The downstream guide portion Gb in the present exemplary embodiment is formed substantially as a flat surface.

The secondary transfer region N (third sliding contact portion) is situated at a portion opposing the secondary transfer roller 20, and has a radius of curvature of 15 mm, forming a contact portion together with the secondary transfer roller 20.

The upstream outlet portion (fourth sliding contact portion) has the function to separate the intermediate transfer belt 10 and the recording material P from each other and the function of a bending portion configured to change the proceeding angle of the intermediate transfer belt 10. The surface thereof on the side where the guide member 18 is held in contact with the intermediate transfer belt 10 is formed as a curved surface of a radius of curvature of 15 mm, which is the same as that of the secondary transfer region N.

The downstream outlet portion Eb (fifth sliding contact portion) has the function to secure the region for arranging a transfer belt cleaning member 16. From the viewpoint of securing the region for the arrangement of the belt cleaning member 16, it is desirable that the portion has a flat surface or a surface of a large radius of curvature. In the present exemplary embodiment, the downstream outlet portion Eb is formed substantially as a flat surface. Further, it is also possible that this downstream outlet portion Eb is provided opposing a detection unit configured to detect density control toner or registration toner on the intermediate transfer belt 10.

Next, the operation of the present exemplary embodiment will be described. The upstream guide portion Ga changes the proceeding angle of the intermediate transfer belt 10, with a radius of curvature of 10 mm, so that it is possible that the region around which the intermediate transfer belt 10 is wrapped, is configured to be large. As a result, the linear pressure of the intermediate transfer belt 10 applied to the wrapped portion is also reduced, so that it is possible to suppress generation of curling.

Figure 7A:
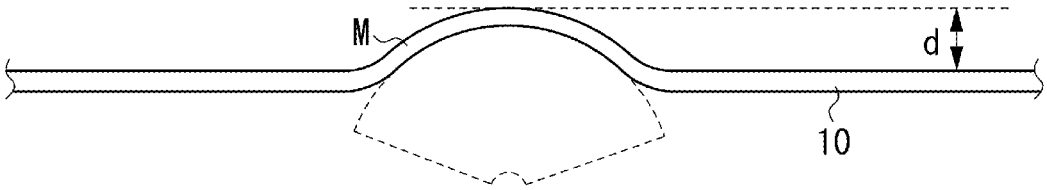
FIG. 7A is an enlarged schematic sectional view illustrating a curling.
Figure 7B:
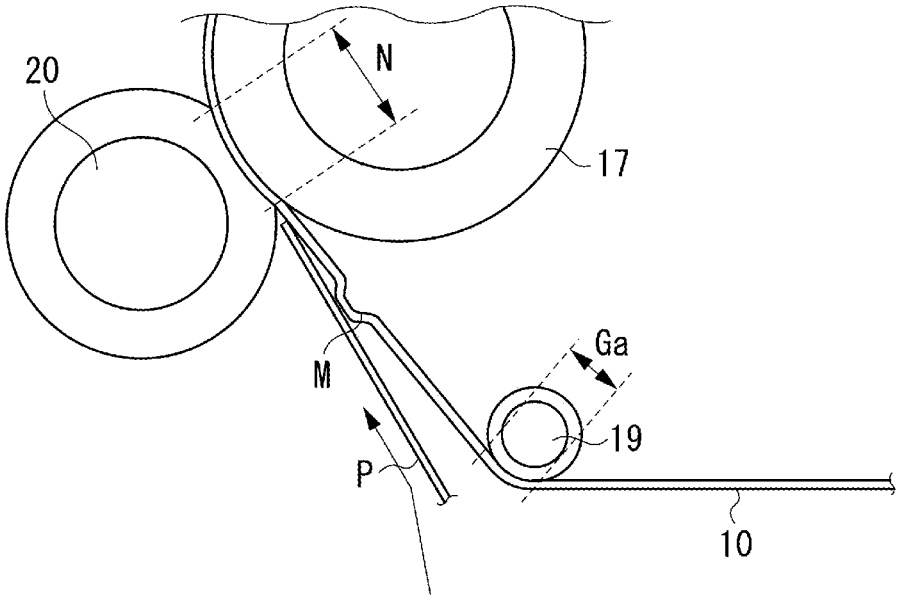
FIG. 7B is a schematic sectional view illustrating a secondary transfer region and a curling.

In the following, the relationship between the radius of curvature and curling will be described with reference to FIGS. 7A, 7B, and 8. FIG. 7A is a schematic sectional view illustrating the intermediate transfer belt 10 in a state where curling has been generated. FIG. 7B is a schematic sectional view illustrating how the toner image is secondarily transferred to the recording material P by the intermediate transfer belt 10 in which the curling is generated.

As illustrated in FIG. 7A, when the intermediate transfer belt 10 remains under high temperature for a long period of time, the curvature configuration of the support roller 19 is memorized as it is, resulting in the generation of a curling portion M. To evaluate the curling portion M, the image forming apparatus is left as it stands in an environment of 35° C./90% for ten days. Then, the image forming apparatus is adapted to an environment of 23° C./50% for one day before making evaluation.

In this way, the image forming apparatus is left as it stands under high temperature for a fixed period of time to maintain a state in which the deformation amount of the belt is increased. After this, the apparatus is restored to room temperature, thereby causing the belt to memorize the curled state. Thus, the evaluation is made under a strict condition in terms of curling. To quantify the curling portion M, the curling height is defined as indicated by d in the diagram. The measurement of the curling portion M is performed by using, for example, a laser shape measuring apparatus, with both ends of the curling portion M being suspended with a predetermined pressure.

Figure 8:
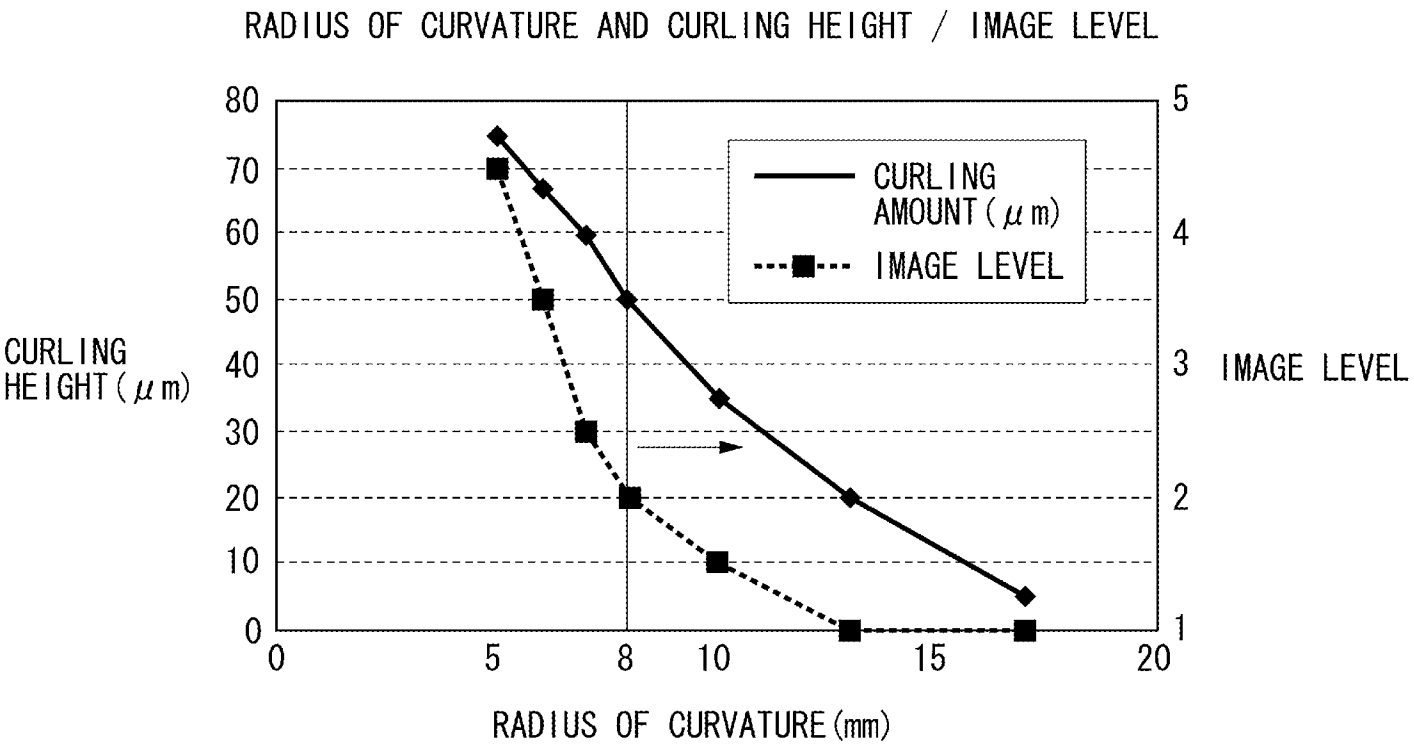
FIG. 8 is a graph illustrating the relationship between radius of curvature, curling amount, and image level.

FIG. 8 is a graph illustrating the relationship between radius of curvature, curling height, and image level. As indicated by the solid line in FIG. 8, in the case where the radius of curvature is small, the wrapping amount with respect to the wrapping angle is small, so that the linear pressure of the intermediate transfer belt 10 applied to the wrapping portion is large. Accordingly, as the radius of curvature decreases, the curling height d tends to be increased. As a result, as illustrated in FIG. 7B, when the recording material P passes the secondary transfer portion N, a step is generated between the recording material P and the curling portion M. Due to this step, a streak-like image defect may be generated in a direction orthogonal to the rotational direction of the intermediate transfer belt 10 (hereinafter referred to as the lateral direction).

The dash line in FIG. 8 indicates the relationship between the radius of curvature and the above-mentioned streak-like image level. In a lateral-streaked image, unevenness in density is likely to be conspicuous. Evaluation was made, for example, on a halftone image formed by the exposure unit 3. The halftone image of approximately 25% compared with a solid image of 100% was evaluated. The image level evaluation was made in five levels. Level 5 is the worst level, whereas level 1 corresponds to a condition free from generation of lateral streaks. In the case of level 2 or under, no streak can be visually recognized in images for practical use, such as a text or a photo image. Thus, in the case of a curling height as generated with a radius of curvature of 8 mm or more, the image is of a level involving no problem. More specifically, in the upstream guide portion Ga of the present exemplary embodiment, the radius of curvature is 10 mm, which means the image is of a level involving no problem in terms of lateral-streak image defect.

The downstream guide portion Gb is formed in a sufficiently large radius of curvature (substantially as a flat surface), and the recording material P enters the secondary transfer region N along the downstream guide portion Gb, so that it is possible for the recording material P to abut the intermediate transfer belt 10 through a sufficient distance. The recording material P is guided to the secondary transfer region N while being held in contact with the intermediate transfer belt 10, so that even if it is affected by the transfer electric field on the upstream side of the secondary transfer region N, the recording material P and the toner image are substantially in contact with each other. Thus, it is possible to suppress generation of splattering.

It is desirable that the radius of curvature of the downstream guide portion Gb is not less than 50 mm so that the recording material P may be allowed to abut from a sufficiently upstream position. Thus, in order to bend the belt, the radius of curvature of the upstream guide portion Ga is smaller than that of the downstream guide portion Gb.

Further, it is advisable to convey the recording material with respect to the intermediate transfer belt such that the position where the leading edge of the recording material comes into contact with the intermediate transfer belt is the boundary between the upstream guide portion Ga and the downstream guide portion Gb. By so doing, it is possible for the length of the downstream guide side portion Gb on the upstream side of the secondary transfer region N to be sufficiently large, making it possible to reliably suppress splattering.

Although it is necessary for the secondary transfer region N to be in a range which does not generate an image defect due to curling of the intermediate transfer belt 10, it is desirable that the radius of curvature thereof is large except for the outlet. On the other hand, regarding the portion near the outlet, it is desirable that its radius of curvature is small from the viewpoint of the separation of the recording material P. In the present exemplary embodiment, the secondary transfer region N exhibits a radius of curvature of 15 mm, so that, from the viewpoint as mentioned above, no problem occurs in terms of curling and the recording material P separation performance.

The upstream outlet portion Ea situated on the downstream side of the secondary transfer region N has the function of separating the intermediate transfer belt 10 and the recording material P from each other and the function of changing the proceeding angle of the intermediate transfer belt 10, so that, from the viewpoint of enhancing the recording material P separation property and the viewpoint of achieving a reduction in apparatus size, it is desirable that the radius of curvature should be small, but within the range which does not generate an image defect due to curling of the intermediate transfer belt 10. In the present exemplary embodiment, the upstream outlet portion Ea exhibits a radius of curvature of 15 mm, so that, from the above viewpoint, no problem occurs in terms of curling and the recording material P separation performance.

Further, as in the first exemplary embodiment, it is also possible to provide a low resistance sliding contact portion in the portion corresponding to the secondary transfer region N. As described above, according to the present invention, the guide member 18 is equipped with a plurality of sliding contact portions differing in radius of curvature in the rotational direction of the intermediate transfer belt 10, whereby it is possible to suppress the generation of splattering in the vicinity of the secondary transfer region, curling, and recording material separation defect by a single member. Further, it is only necessary for the guide member to fulfill its function solely by the surface thereof in sliding contact with the intermediate transfer belt 10, so that it is possible for the inner peripheral surface side of the guide member 18 to be made as small as possible.

Next, another exemplary embodiment of the present invention will be described. The basic construction of the image forming apparatus according to the fourth exemplary embodiment is the same as that of the first exemplary embodiment. Thus, the components of the same or equivalent function and construction as those of the first exemplary embodiment are indicated by the same reference numerals, and a detailed description thereof will be omitted.

The feature of the present exemplary embodiment lies in that, as compared with the construction of the guide member 13 according to the first exemplary embodiment, a guide member 28 exhibits different radiuses of curvature on the upstream and downstream sides of the secondary transfer region N, and that it is formed substantially as a flat surface in the secondary transfer region N.

Figure 9:
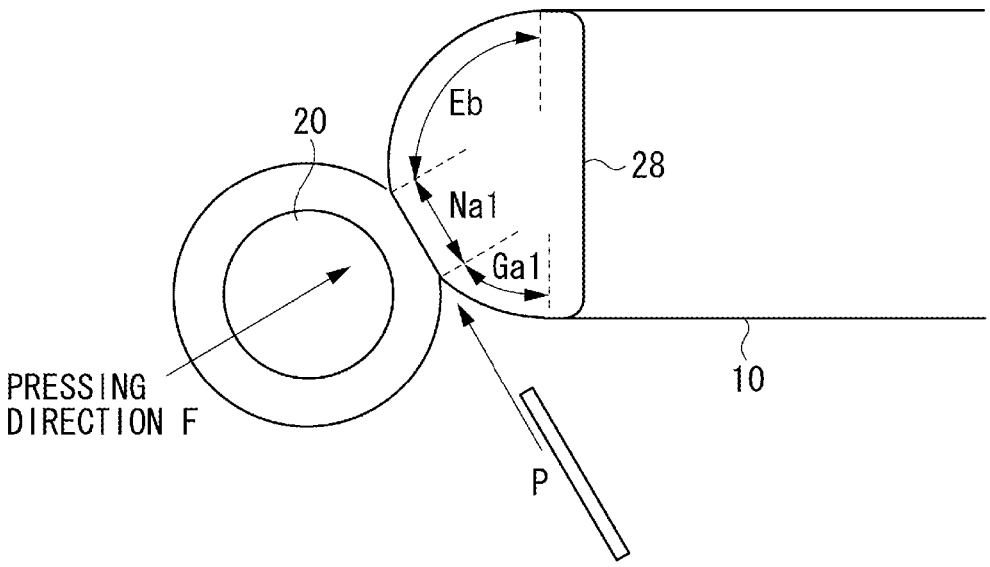
FIG. 9 is an enlarged schematic sectional view of the portion in the vicinity of the secondary transfer region of the image forming apparatus according to the third exemplary embodiment.

FIG. 9 is a schematic enlarged cross-sectional view of the portion in the vicinity of the secondary transfer portion of the image forming apparatus according to the present exemplary embodiment. The guide member 28 is formed so as to have a width of 250 mm in the longitudinal direction which is a direction orthogonal to the moving direction, and have a substantially semi-circular configuration of a radius of curvature of 10 mm. The surface of the guide member 28 held in sliding contact with the intermediate transfer belt 10 is formed by a plurality of continuous sliding contact portions. More specifically, it is divided into a upstream guide portion Ga1, a secondary transfer region Na1, and a downstream outlet portion Eb.

The upstream guide portion Ga1 (upstream regulation portion) functions as a bending portion configured to change the rotational angle of (bend) the intermediate transfer belt 10, and the surface thereof on the side where the guide member 28 and the intermediate transfer belt 10 are held in contact with each other is formed as a curved surface of a radius of curvature of 50 mm. From the viewpoint of curling, in the intermediate transfer belt according to the present exemplary embodiment, it is necessary for the radius of curvature to be not less than 8 mm (not less than a predetermined value). The predetermined value of the radius of curvature needed to suppress curling can be changed as appropriate according to the material forming the intermediate transfer belt.

The secondary transfer region Na1 (second sliding contact portion) is situated at the opposing portion of the secondary transfer roller 20, and is formed substantially as a flat surface, forming a contact portion together with the secondary transfer roller 20. The downstream guide portion Eb (downstream regulation portion) has the function of separating the intermediate transfer belt 10 and the transfer material P from each other as well as the function of a bending portion for changing the proceeding angle of the intermediate transfer belt 10. The surface thereof on the side where the guide member 28 and the intermediate transfer belt are held in contact with each other is formed as a curved surface of a radius of curvature of 12 mm.

The transfer material P starts to be separated from the intermediate transfer belt 10 in the tangential direction at the most downstream position of the secondary transfer portion Na1. Depending on the separating direction of the leading edge portion of the transfer material P, an electrostatic adsorption force generated between the transfer material P and the intermediate transfer belt 10 after the secondary transfer process greatly fluctuates, greatly affecting the transfer material P separation performance.

When the proceeding direction of the leading edge portion of the transfer material P after passing the secondary transfer region N is nearer to the secondary transfer roller with respect to the fictive line connecting the upstream and downstream sides of the secondary transfer region N, the electrostatic adsorption force generated between the transfer material P and the intermediate transfer belt 10 can be smaller than the bending stress of the transfer material P even in the case where a paper of low rigidity like a thin sheet is used as the transfer material P. An electrostatic force generated between the transfer material P and the intermediate transfer belt 10 is in inverse proportion to the square of the distance between the transfer material P and the intermediate transfer belt 10.

If the above-mentioned electrostatic adsorption force exceeds the bending stress caused by the rigidity of the transfer material P, the transfer material P is attracted to the intermediate transfer belt 10 to be completely adsorbed onto the intermediate transfer belt 10, so that the transfer material P is not separated from the intermediate transfer belt 10, and is not conveyed to the fixing device for the next process, resulting in the generation of jamming or the like.

Figure 10:
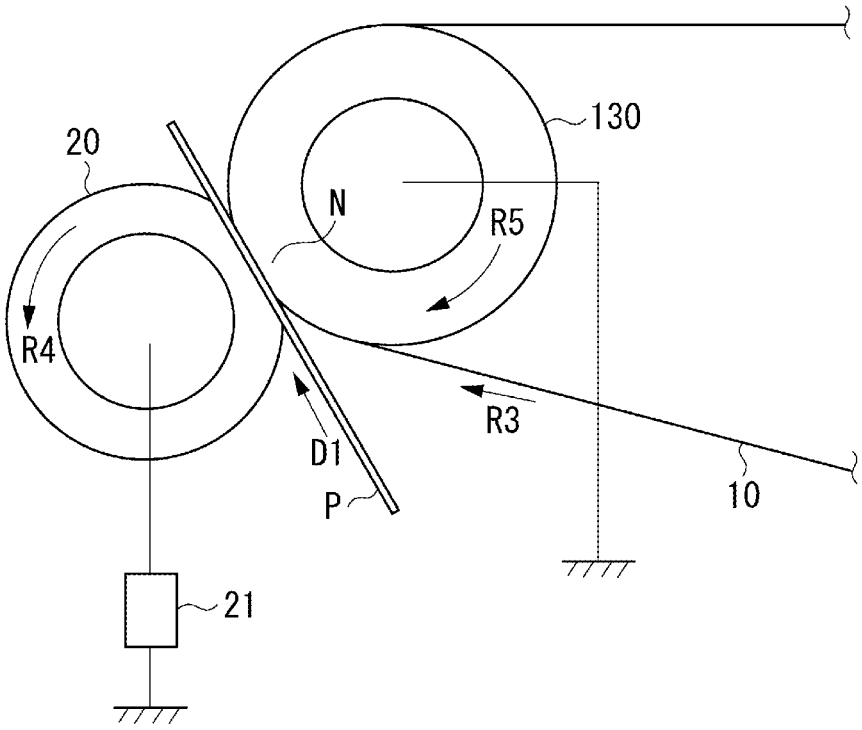
FIG. 10 is an enlarged schematic sectional view of a portion in the vicinity of a secondary transfer region of an image forming apparatus according to a comparative example of the third exemplary embodiment.

To specifically describe the operation of the present exemplary embodiment, an image forming apparatus constructed according to a comparative example illustrated in FIG. 10 will be described. As illustrated in FIG. 10, the image forming apparatus according to the comparative example employs a driven roller 130 as the opposing member of the secondary transfer region N. Otherwise, it is of the same construction as the image forming apparatus illustrated in FIG. 1.

Figure 11A:
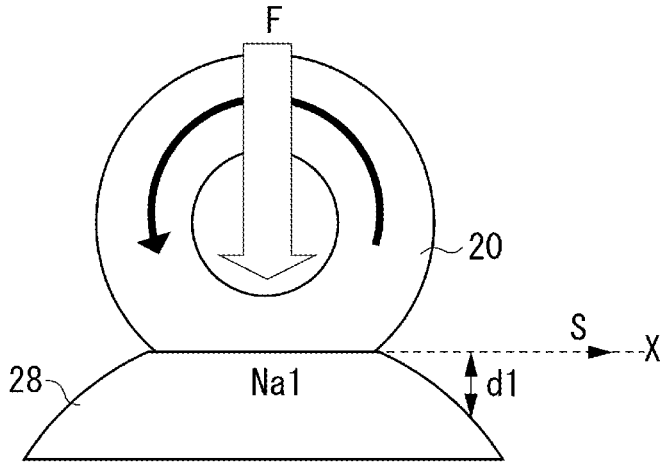
FIG. 11A is a diagram illustrating a separating direction of the secondary transfer region and a transfer material in the third exemplary embodiment.
Figure 11B:
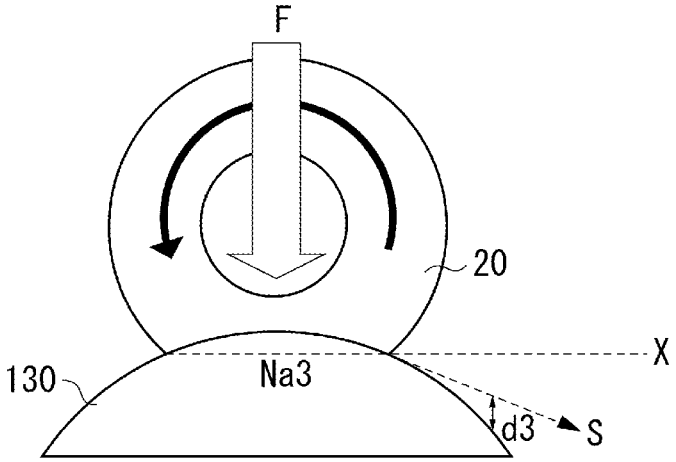
FIG. 11B is a diagram illustrating the separating direction of the secondary transfer region and the transfer material in the comparative example.

FIG. 11A is an enlarged schematic diagram illustrating the portion in the vicinity of the secondary transfer portion according to the present exemplary embodiment. FIG. 11B is an enlarged schematic diagram illustrating the portion in the vicinity of the secondary transfer portion according to the comparative example. In both FIGS. 11A and 11B, the secondary transfer roller 20 consists of an elastic member. The secondary transfer roller 20 is crushed by a pressing force F, whereby the secondary transfer portion is formed. Both diagrams illustrate the intrusion amount of the secondary roller 20 when forming secondary transfer portions of the same width.

As illustrated in FIG. 4B, in the construction according to the comparative example, the curved surfaces of the secondary transfer roller 20 and the guide member 13 face each other. Accordingly, the secondary transfer portion Na3 is of a convex configuration with respect to the pressing direction F of the secondary transfer roller 20. Thus, at the separation start position, the proceeding direction S of the transfer material P is nearer to the intermediate transfer belt 10 with respect to the straight line X connecting the most upstream position and the most downstream position of the secondary transfer portion. The distance d3 between the transfer material P and the intermediate transfer belt 10 is reduced, and the electrostatic adsorption force generated between them increases. The drive roller 130 regulates the direction of the leading edge of the transfer material when it passes the secondary transfer portion such that the transfer material having passed the secondary transfer portion becomes nearer to the secondary transfer roller than to the intermediate transfer belt.

As illustrated in FIG. 4A, in the construction according to the present exemplary embodiment, since the guide member has a substantially flat shape, the secondary transfer portion Na1 also has a substantially flat configuration. Thus, the proceeding direction S of the leading edge of the transfer material P at the separation start position is in the straight line X connecting the most upstream position and the most downstream position of the secondary transfer portion, and the movement path of the intermediate transfer belt 10 is a straight line. The distance d1 between the transfer material P and the intermediate transfer belt 10 is larger than the distance d2. As a result, the electrostatic adsorption force generated between them can be smaller than that in the comparative example. Even when the proceeding direction S of the leading edge of the transfer material P is the same, the larger the radius of curvature of the guide member configuration Eb from the secondary transfer portion onward, the smaller the distance between the transfer material P and the intermediate transfer belt 10. As a result, the electrostatic adsorption force generated between them increases, and the transfer material P separation performance deteriorates, so that it is desirable that the radius of curvature of Eb is small.

Table 1 shows the results of evaluation of the transfer material P separation property in the image forming apparatus according to the comparative example and that according to the present exemplary embodiment. To evaluate the separation property, 100 A4 size thin sheets (grammage: 47 g/cm2) were passed under a high-temperature, high-humidity condition of 30° C. and 80%. On this condition the proportion of defective separation was evaluated. In the construction of the comparative example, 5% of defective separation was generated, whereas, in the construction of the present exemplary embodiment, no defective separation was generated.

TABLE 1

| | First exemplary embodiment | Comparative example |
|---|---|---|
| Nip Configuration | Substantially flat | Convex |
| Proportion of defective separation | 0 | 5% |

As described above, according to the present exemplary embodiment, by forming the guide member 28 corresponding to the secondary transfer portion substantially as a flat surface, the direction in which the separation of the transfer material P is started is set to the one weakening the electrostatic adsorption force generated between the guide member and the intermediate transfer belt 10, making it possible to achieve an improvement in terms of the separation performance of the image forming apparatus.

Figure 12A:
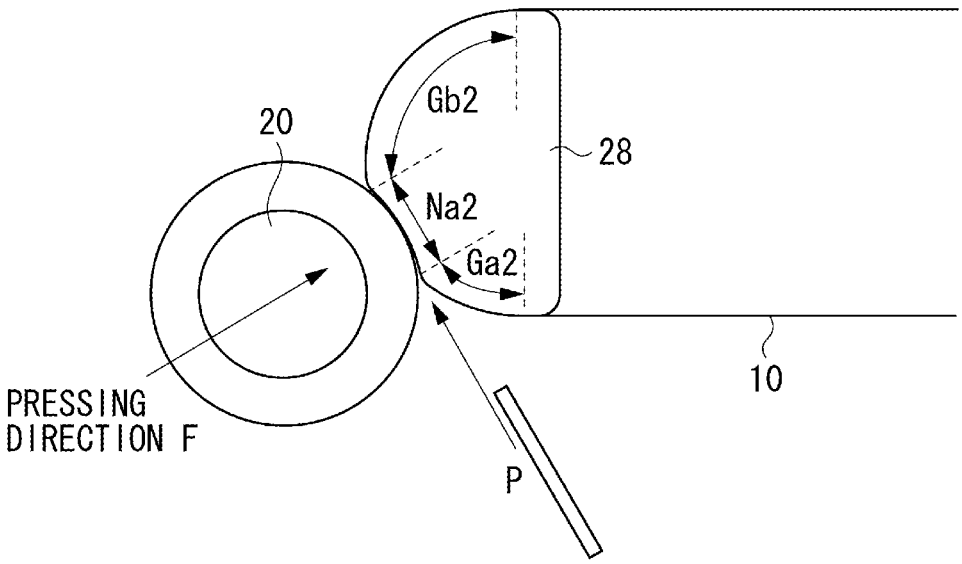
FIG. 12A is a diagram illustrating the portion in the vicinity of the secondary transfer region of an image forming apparatus according to a modification of the third exemplary embodiment.

Further, as illustrated in FIG. 12, it is also possible that the guide member 28 is equipped with a recess with respect to the pressing direction F of the secondary transfer roller 20. FIG. 13 is a diagram illustrating the radius of curvature in the secondary transfer region Na2. As illustrated in FIG. 13, the recess of the guide member 28 is formed such that the radius of curvature r1 thereof is larger than the radius r2 of the secondary transfer roller 20. Further, the inflection points A and B of the radius of curvature constituting the joint between the guide member configuration Na2 and the guide member configuration Ga2 or Gb2 are not included in the nip width of the secondary transfer roller.

More specifically, of the guide member configurations not corresponding to the secondary transfer portion, the portion on the upstream side of the transfer nip is referred to as Ga2, and the portion on the downstream side thereof is referred to as Gb2. It is configured in an arcuate form such that the portion Ga2 exhibits a radius of curvature of 50 mm and that the portion Gb2 exhibits a radius of curvature of 12 mm. The guide member configuration Na2 is an arcuate configuration of a radius of curvature of 10 mm. It is concave in the pressing direction of the secondary transfer roller 20, and its radius of curvature is larger than the radius of the secondary transfer roller, which is 9 mm. Further, the inflection point portion of the radius of curvature constituting the joint between the guide member configuration Na2 and the guide member configuration Gb2 is given an appropriate degree of roundness.

Figure 12B:
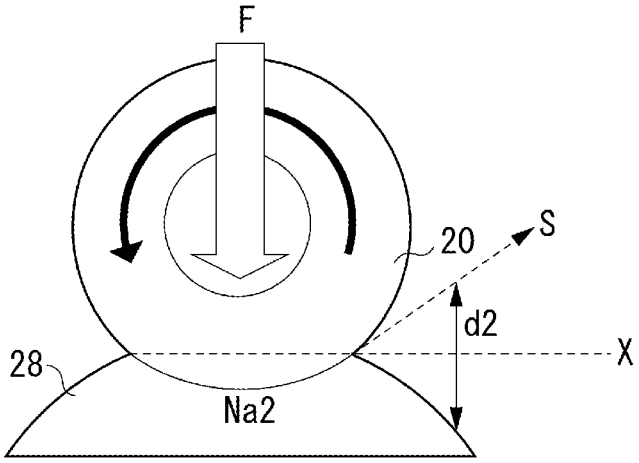
FIG. 12B is a diagram illustrating the separating direction of the portion in the vicinity of the secondary transfer region and the transfer material in the third exemplary embodiment.
Figure 13:
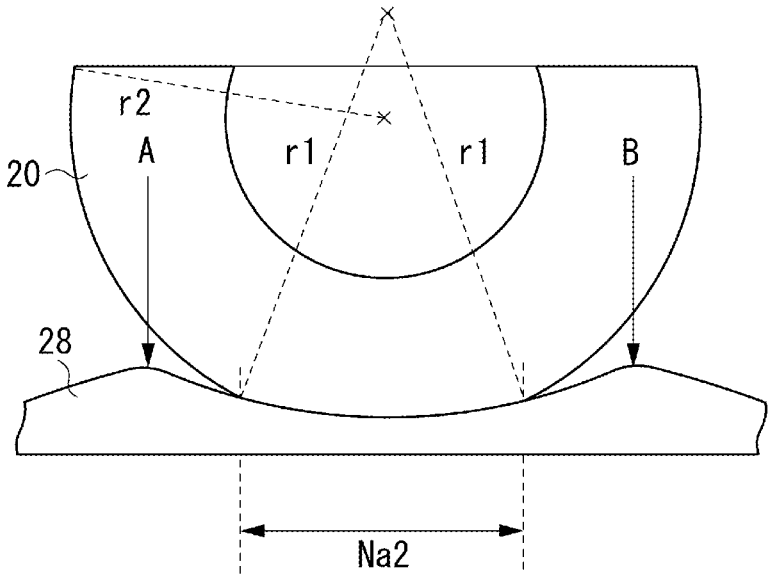
FIG. 13 is a diagram illustrating the radius of curvature at each portion of the secondary transfer region in the modification of the third exemplary embodiment.

As illustrated in FIG. 12B, the secondary transfer region Na2 is of a concave configuration with respect to the pressing direction F of the secondary transfer roller 20. Thus, the proceeding direction S of the leading edge of the transfer material P at the separation start position is nearer to the secondary transfer roller 20 with respect to the straight line X connecting the most upstream position and the most downstream position of the secondary transfer portion, and the distance d2 between the transfer material P and the intermediate transfer belt 10 increases. As a result, it is possible to make the electrostatic adsorption force generated between them smaller than in the comparative example.

The radius of curvature of the secondary transfer roller 20 is smaller than the radius of curvature of the guide member, and the material of the secondary transfer roller 20 has a sponge-like configuration, so that the material does not easily adsorb. Thus, regarding the separation of the transfer material to the secondary transfer roller 20 side, no problem occurs as far as the wrapping of the transfer material P around the secondary transfer roller 20 is concerned. Since the inflection point portions A and B of the radius of curvature constituting the joint between the guide member configurations Ga2, Gb2 and the guide member configuration Na2 are on the outer side of the secondary transfer region Na2, it is possible to regulate the proceeding direction of the leading edge of the transfer material P so as to be reliably on the secondary transfer roller 20 side.

Next, another exemplary embodiment of the present invention will be described. The basic construction of the image forming apparatus according to the present exemplary embodiment is the same as that of the first exemplary embodiment. Thus, the components of the same or equivalent function and construction as those of the first exemplary embodiment are indicated by the same reference numerals, and a detailed description thereof will be omitted.

Figure 14:
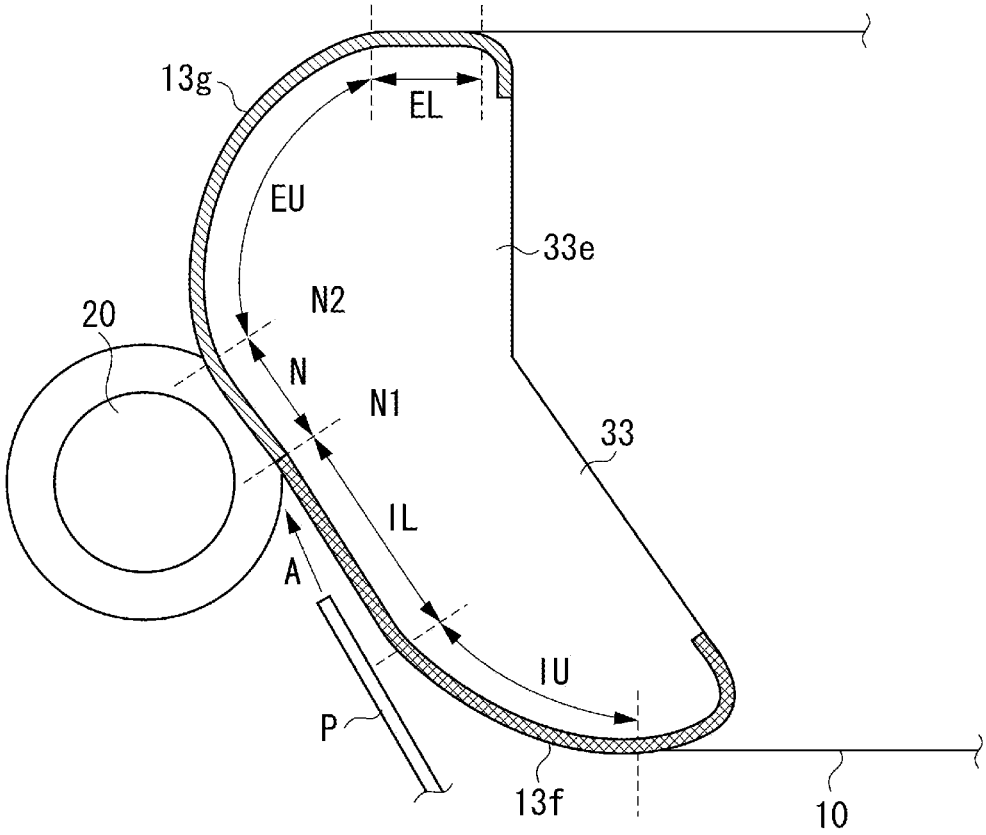
FIG. 14 is an enlarged schematic sectional view of a portion in the vicinity of a secondary transfer region of an image forming apparatus according to a fourth exemplary embodiment.

As compared with the construction of the guide member 13 according to the first exemplary embodiment illustrated in FIG. 14, the feature of the present exemplary embodiment lies in that the surface of a guide member 33 held in contact with the intermediate transfer belt 10 is formed by a combination of a flat surface and curved surfaces differing in curvature.

FIG. 14 is an enlarged schematic cross-sectional view of the portion in the vicinity of the secondary transfer region of the image forming apparatus according to the present exemplary embodiment.

The surface of the guide member 33 held in sliding contact with the intermediate transfer belt 10 is divided into an inlet upstream region IU, an inlet downstream region IL, the secondary transfer region N, an outlet upstream region EU, and an outlet downstream region EL.

From the viewpoint of preventing an image defect due to curling of the intermediate transfer belt 10, it is desirable that the sliding contact surfaces of all the regions of the guide member 33 is formed as curved surfaces having a radius of curvature of 8 mm or more or substantially as flat surfaces.

In the inlet upstream region IU (first bending portion), the guide member 33 has the function of changing the proceeding angle of the intermediate transfer belt 10. In the present exemplary embodiment, the sliding contact surface of the guide member 33 of the nip inlet upstream region IU is formed as a curved surface of a radius of curvature of 10 mm. In this way, regarding the guide member 33, the nip inlet upstream region IU determining the curvature of the intermediate transfer belt 10 can also be formed integrally. Unlike the roller configuration, the guide member 13 is a stationary member, so that its configuration can also be freely selected.

By forming the nip inlet upstream region IU as a curved surface of a large radius of curvature, the guide member 33 suppresses the generation of curling in the intermediate transfer belt 10. In the construction of the present exemplary embodiment, the portion where the secondary transfer belt 10 is bent (the inlet upstream region IU) is formed as a curved surface of a large radius of curvature, so that it is possible to suppress an increase in the size of the apparatus advantageously.

In the nip inlet downstream region IL, the guide member 33 has the function of causing the intermediate transfer belt 10 to enter the secondary transfer region N while holding it in close proximity to the recording material P. By holding the intermediate transfer belt 10 and the recording material P in close proximity to each other, it is possible to shorten the movement distance when the toner on the intermediate transfer belt 10 moves to the recording material P in the upstream side of the secondary transfer region N, so that the deviation from a predetermined position is reduced, making it possible to suppress splattering.

It is desirable that the sliding contact surface of the guide member 33 in the recording material nip inlet downstream region IL is formed substantially as a flat surface or a curved surface of a very large radius of curvature. In this case, it is possible to bring the intermediate transfer belt 10 and the recording material P into close proximity to each other from a position away from the secondary transfer region N, which is advantageous from the viewpoint of suppression of splattering. In the present exemplary embodiment, the inlet downstream region IL is formed substantially as a flat surface.

In the inlet upstream region IU and the inlet downstream region IL, there is arranged a high resistance sliding contact portion 13*f* in order to suppress splattering.

In the secondary transfer region N, the guide member 33 has to function as the opposing member and the opposing electrode of the secondary transfer roller 20. The transfer of the toner image to the recording material P is substantially carried out in the secondary transfer region N. Thus, in the secondary transfer region of the guide member 33, there is arranged a low resistance sliding contact portion 13*g* functioning as the opposing electrode.

In the secondary transfer region N, the sliding contact surface of the guide member 33 may have any shape so long as it is not in a range where an image defect is generated due to curling of the intermediate transfer belt 10. In the present exemplary embodiment, the sliding contact surface of the guide member 33 in the secondary transfer region N is formed as a curved surface of a radius of curvature of 15 mm. Further, the secondary transfer region N of the guide member 33 may be concave with respect to the pressing direction F of the secondary transfer roller 20. Owing to this configuration, it is possible to regulate the proceeding direction of the leading edge of the transfer material P so as to be reliably on the secondary transfer roller 20 side. Otherwise, as in the fourth exemplary embodiment, it is possible to adopt a substantially flat surface configuration.

In the outlet upstream region EU (second bending portion), the guide member 33 has the function of separating the intermediate transfer belt 10 and the recording material P from each other, and the function of changing the proceeding angle of the intermediate transfer belt 10. From the viewpoint of enhancing the recording material P separation property and the viewpoint of achieving a reduction in apparatus size, it is desirable that the radius of curvature is small within the range which does not generate an image defect due to curling of the intermediate transfer belt 10. In the present exemplary embodiment, the sliding contact surface of the outlet upstream region EU of the guide member 33 is formed as a curved surface of a radius of curvature of 10 mm. The inlet upstream region IU bending the secondary transfer belt 10 exhibits a larger radius of curvature than that of the outlet upstream region EU.

In the nip outlet downstream region EL, the guide member 33 has the function of securing a region for arranging the transfer belt cleaning member 16. On the other hand, from the viewpoint of securing the region for arranging the belt cleaning member 16, it is desirable that the region is a flat surface or a surface of a large radius of curvature.

In the present exemplary embodiment, the sliding contact surface of the outlet downstream region EL of the guide member 33 consists of a flat surface. To prevent discharge or the like when separating the intermediate transfer belt 10 from the guide member 33, the same low resistance sliding contact portion 13*g* as that in the secondary transfer region N is arranged in the outlet upstream region EU and the outlet downstream region EL.

As in the first exemplary embodiment, the high resistance sliding contact portion 13*f* and the low resistance sliding contact portion 13*g* are supported by the guide support member 13*e*. The high resistance sliding contact portion 13*f* exhibits a higher electrical resistance than the low resistance sliding contact portion 13*g*. More specifically the high resistance sliding contact portion is formed of a super high-molecular polyethylene sheet member of a volume resistivity of not less than $10^{12}$ Ω·cm and a thickness of 0.2 mm. The super high-molecular polyethylene is a polyethylene whose molecular mass is increased to a level of around 5 million. It is generally known as a material superior in slipping property and wear resistance. As the low resistance sliding contact portion 13*g*, a super high-molecular polyethylene sheet member of a thickness of 0.2 mm is used in which carbon is dispersed as a conductive agent. The electrical resistance of this conductive super high-molecular polyethylene sheet is not more than $10^7$ Ω·cm in terms of volume resistivity.

As described above, the transfer opposing member is formed not of a rotating body such as the transfer counter roller 17 as used in the conventional image forming apparatus but of a guide member held in sliding contact with the intermediate transfer belt 10, whereby it is possible to locally change not only the arrangement of the opposing electrode and the resistance value but also the configuration of the sliding surface of the guide member.

As a result, it is possible to regulate the electric field in the vicinity of the secondary transfer region N according to the place, and to suppress generation of curling in the secondary transfer belt 10. Further, it is possible to move the intermediate transfer belt 10 while holding it in close proximity to the recording material P in front of the secondary transfer region N. Further, the recording material having passed the secondary transfer region N can be easily separated from the intermediate transfer belt 10. For the reasons mentioned above, it is possible to provide a high quality image with far less splattering.

While the present invention has been described with reference to exemplary embodiments, it is to be understood that the disclosure is not limited to the disclosed exemplary embodiments. The scope of the following claims is to be accorded the broadest interpretation so as to encompass all modifications, equivalent structures, and functions.

This application claims priority from Japanese Patent Application No. 2011-256705 filed Nov. 24, 2011, No. 2011-256706 filed Nov. 24, 2011, No. 2011-256707 filed Nov. 24, 2011, and No. 2011-286210 filed Dec. 27, 2011, which are hereby incorporated by reference herein in their entirety.

What is claimed is:

1. An image forming apparatus comprising:

an image bearing member bearing a toner image;

an endless intermediate transfer belt, which is rotatable and to which the toner image is primarily transferred from the image bearing member;

a secondary transfer member contacting an outer surface of the endless intermediate transfer belt and configured to form a secondary transfer region together with the endless intermediate transfer belt, the toner image on the endless intermediate transfer belt being transferred to a transfer material conveyed to the secondary transfer region;

a secondary transfer power source configured to apply a voltage to the secondary transfer member; and a guide member not being driven to rotate together with the moving endless intermediate transfer belt and configured to guide the endless intermediate transfer belt, wherein the guide member faces the secondary transfer member across the endless intermediate transfer belt and includes a first resistor portion in sliding contact with the endless intermediate transfer belt and a second resistor portion in sliding contact with the endless intermediate transfer belt in a rotational direction of the endless intermediate transfer belt, and wherein the second resistor portion has a higher electrical resistance than the first resistor portion and is disposed on an upstream side of the first resistor portion in a moving direction of the endless intermediate transfer belt, wherein the secondary transfer member to which a voltage is applied from the secondary transfer power source faces the first resistor portion and the second resistor portion through the endless intermediate transfer belt.

2. The image forming apparatus according to claim 1, wherein the guide member includes a guide support member supporting the first resistor portion and the second resistor portion.

3. The image forming apparatus according to claim 2, wherein the second resistor portion reduces an electric field generated between the secondary transfer member and the second resistor portion when the secondary transfer power source applies a voltage to the secondary transfer member to become smaller than an electric field generated in a region corresponding to the first resistor portion.

4. The image forming apparatus according to claim 2, wherein the first and second resistor portions are not driven to rotate together with the moving endless intermediate transfer belt, and fixed to the guide support member.

5. The image forming apparatus according to claim 1, wherein the second resistor portion functions as a support portion supporting the first resistor portion.

6. The image forming apparatus according to claim 1, wherein, in the rotational direction of the endless intermediate transfer belt, a most upstream end of the first resistor portion is disposed at least at a same position as a most upstream end of the secondary transfer region or at a position on a downstream side thereof.

7. The image forming apparatus according to claim 1, wherein, in the rotational direction of the endless intermediate transfer belt, the guide member includes a first bending region configured to bend the endless intermediate transfer belt to an upstream side of the secondary transfer region, and a second bending region configured to bend the endless intermediate transfer belt to a downstream side of the secondary transfer region and a curvature of the second bending region is smaller than that of the first bending region, and wherein the second resistor portion is disposed in the first bending region.

8. The image forming apparatus according to claim 1, wherein the first resistor portion is electrically grounded.

9. The image forming apparatus according to claim 8, wherein, in the rotational direction of the endless intermediate transfer belt, the first resistor portion is provided at a position corresponding to the secondary transfer region.

10. The image forming apparatus according to claim 1, wherein the second resistor portion is super high-molecular polyethylene with no conductivity.

11. An image forming apparatus comprising:

an image bearing member bearing a toner image;

an endless intermediate transfer belt, which is rotatable and to which the toner image is primarily transferred from the image bearing member;

a plurality of support members supporting an inner peripheral surface of the endless intermediate transfer belt; and a secondary transfer member contacting an outer surface of the endless intermediate transfer belt and configured to form a secondary transfer region together with the endless intermediate transfer belt, the toner image on the endless intermediate transfer belt being transferred to a transfer material conveyed to the secondary transfer region, wherein one of the plurality of support members is a guide member configured to regulate a rotational direction of the endless intermediate transfer belt while slide-contacting the endless intermediate transfer belt at a position opposite the secondary transfer member across the endless intermediate transfer belt, and wherein the guide member includes a plurality of sliding contact portions differing in respective radii of curvature in the rotational direction of the endless intermediate transfer belt, wherein, in the rotational direction of the endless intermediate transfer belt, the plurality of sliding contact portions include at least a first sliding contact portion configured to bend the endless intermediate transfer belt, and a second sliding contact portion configured to regulate a position of the endless intermediate transfer belt where a leading edge of the transfer material conveyed to a secondary transfer nip is brought into contact with the endless intermediate transfer belt, and wherein a radius of curvature of the first sliding contact portion is less than a radius of curvature of the second sliding contact portion, and wherein the guide member supports an inner peripheral surface of the endless intermediate transfer belt corresponding to the secondary transfer nip with a third sliding contact portion of a smaller radius of curvature than the second sliding contact portion.

12. The image forming apparatus according to claim 11, wherein the first sliding contact portion has a radius of curvature greater than or equal to a predetermined value.

13. The image forming apparatus according to claim 11, wherein the transfer material is conveyed to the secondary transfer nip along the endless intermediate transfer belt, whose rotational direction is regulated by the second sliding contact portion.

14. The image forming apparatus according to claim 11, wherein the position where the leading edge of the transfer material comes into contact with the intermediate transfer belt is a position corresponding to a boundary between the first sliding contact portion and the second sliding contact portion.

15. The image forming apparatus according to claim 11, wherein, on downstream of the third sliding contact portion, the guide member includes a fourth sliding contact portion having a curvature for bending the endless intermediate transfer belt to separate the transfer material from the endless intermediate transfer belt.

16. The image forming apparatus according to claim 11, wherein the guide member regulates a direction of the leading edge of the transfer material when the transfer material passes the secondary transfer region such that the transfer material having passed the secondary transfer region is nearer to the secondary transfer member than to the endless intermediate transfer belt.

17. The image forming apparatus according to claim 16, wherein a shape of the secondary transfer region of the guide member is such that a movement path of the endless intermediate transfer belt in the secondary transfer region becomes a straight line.

18. The image forming apparatus according to claim 16, wherein a shape of the secondary transfer region of the guide member is concave toward the guide member from the secondary transfer member.

* * * * *